US010153590B2

(12) United States Patent
Huang

(10) Patent No.: US 10,153,590 B2
(45) Date of Patent: Dec. 11, 2018

(54) SOCKET STRUCTURE CAPABLE OF PREVENTING PLUGS FROM DROPPING OFF

(71) Applicant: Pei-Lin Huang, New Taipei (TW)

(72) Inventor: Pei-Lin Huang, New Taipei (TW)

( * ) Notice: Subject to any disclaimer, the term of this patent is extended or adjusted under 35 U.S.C. 154(b) by 0 days.

(21) Appl. No.: 15/861,142

(22) Filed: Jan. 3, 2018

(65) Prior Publication Data

US 2018/0198235 A1 Jul. 12, 2018

(30) Foreign Application Priority Data

Jan. 10, 2017 (TW) ..... 106100762 A

(51) Int. Cl.

| | |
|---|---|
| ***H01R 13/625*** | (2006.01) |
| ***H01R 13/639*** | (2006.01) |
| ***H01R 13/635*** | (2006.01) |
| ***H01R 13/652*** | (2006.01) |
| ***H01R 24/78*** | (2011.01) |
| *H01R 13/20* | (2006.01) |

(52) U.S. Cl.

CPC ..... *H01R 13/6395* (2013.01); *H01R 13/635* (2013.01); *H01R 13/652* (2013.01); *H01R 24/78* (2013.01); *H01R 13/20* (2013.01); *H01R 13/639* (2013.01)

(58) Field of Classification Search

USPC ..... 439/346

See application file for complete search history.

(56) References Cited

U.S. PATENT DOCUMENTS

| | | | | |
|---|---|---|---|---|
| 8,668,512 | B2 * | 3/2014 | Chang | H01R 24/78 439/304 |
| 8,714,995 | B2 * | 5/2014 | Chang | H01R 13/639 439/345 |
| 9,929,510 | B2 * | 3/2018 | Vass | H01R 13/6395 |
| 2018/0054030 | A1 * | 2/2018 | Hewitt | H01R 13/639 |
| 2018/0062317 | A1 * | 3/2018 | Hartman | H01R 13/639 |

* cited by examiner

*Primary Examiner* — Tho D Ta

(74) *Attorney, Agent, or Firm* — Muncy, Geissler, Olds & Lowe, P.C.

(57) ABSTRACT

A socket structure is disclosed, which includes a socket body combined with a slantingly installed positioning plate, an opening is configured on the positioning plate and corresponds to a neutral wire power jack on the socket body, a high edge of the positioning plate is pushed and abutted by the top end of a release piece whose bottom includes a first elastic body, while a second elastic body abuts the positioning plate close to the high edge, the elasticity in the second elastic body is smaller than the elasticity of the first elastic body; in addition, when the positioning plate is in the inclination state, it is possible to snap in fixation the neutral wire insertion plate by means of the opening in the positioning plate; upon pressing down the release piece, however, the high edge of the positioning plate can be pushed downwards by means of the second elastic body such that the positioning plate stably turns back to a horizontal state thereby releasing the neutral wire insertion plate of the electric power plug.

9 Claims, 6 Drawing Sheets

SOCKET STRUCTURE CAPABLE OF PREVENTING PLUGS FROM DROPPING OFF

BACKGROUND OF THE INVENTION

1. Field of the Invention

The present invention generally relates to a socket structure; in particular, it relates to a socket structure capable of preventing electric power plugs from dropping off.

2. Description of Related Art

Typically, upon using a general electrical appliance, when a power plug is inserted into a socket and powered up, whether the power plug will fall off or not relies on the tightness difference clamped between the plug plates and the conductive copper plates installed inside the socket holes. However, once this plug insertion mating loosens, if an external pulling force does inadvertently occur, it may pull out the entire plug and cause the plug to fall off from the socket thus leading to power supply interruptions.

Moreover, in case that the plug inserted in the socket is affected by an external force and starts to loosen, it may potentially cause a dangerous situation of accidental electric shock. Therefore, how to make the plug stably inserted within the socket holes and not easily falling off from the socket because of such external forces become the current problem to be solved.

Accordingly, the present invention would be an optimal solution suppose it is possible to devise a socket structure capable of abutting the plug so as to prevent the plug from being pulled out after the plug is inserted into the socket holes thereby overcoming the aforementioned dangerous situations of power-off and accidental electric shock.

SUMMARY OF THE INVENTION

The present invention discloses a socket structure capable of preventing electric power plugs from dropping off.

The socket structure according to the present invention comprises: an external cover, including a socket panel and a housing of an outer frame plane, wherein a ring-shaped groove is configured between the socket panel and the outer frame plane, the socket panel has a live wire insertion hole, an earth wire insertion hole and a neutral wire insertion hole, the outer frame plane has a through channel, an accommodation groove extends on the inner wall plane of the socket panel, an inclination mechanism is set up within the accommodation groove, and a stopper is installed on the sidewall close to the neutral wire insertion hole while the plane at one end of the stopper remote to the neutral wire insertion hole is an inclined plane; a positioning plate, having an eccentrically installed opening, in which the positioning plate is contained within the accommodation groove of the external cover, the inclination mechanism inside the accommodation groove allows the positioning plate to be slantingly installed so that the two ends thereof respectively form a high edge and a low edge, the opening is close to the low edge near the neutral wire insertion hole and its edge contacts the inclined plane of the stopper, the high edge and the low edge are not fixedly placed within the accommodation groove, and the opening corresponds to the neutral wire insertion hole; a second elastic body, in which one of whose ends abuts the wall plane of the accommodation groove while the other one abuts the surface of the high edge in the positioning plate so as to exhibit an elasticity storage state; and a release piece, which has a press rod, a linkage bar and a supporting column, wherein the two ends of the linkage bar are respectively connected to the press rod and the bottom of the supporting column such that the press rod and supporting column can move conjunctively, and the top of the press rod has a press head, the top plane of the supporting column is an inclined plane; thus, the release piece can be combined into the external cover so that the press rod penetrates through the channel in the outer frame plane thereby allowing the press head to be exposed to the outside of the channel, while the inclined plane on the top end of the supporting column abuts the other surface of the high edge in the positioning plate such that the positioning plate can be stably and slantingly accommodated within the accommodation groove;

a socket body, including a base stage, a live wire power jack, an earth wire power jack and a neutral wire power jack, in which the socket body can be combined with the external cover such that the live wire power jack, the earth wire power jack and the neutral wire power jack respectively correspond to the live wire insertion hole, the earth wire insertion hole and the neutral wire insertion hole on the socket panel; and a first elastic body, in which one of whose ends abuts the bottom of the release piece while the other end abuts the base stage of the socket body in order to maintain in an elasticity release state, and the elasticity in the first elastic body is greater than the elasticity in the second elastic body.

In an embodiment, the accommodation groove of the external cover includes two corresponding long sidewall planes and short sidewall planes, and the short sidewall planes are the sidewalls of the external cover while the long sidewall planes are formed by respective downward extensions individually from the lateral edge of the live wire insertion hole and the earth wire insertion hole, such that the accommodation groove is located between the live wire insertion hole and the earth wire insertion hole, while the neutral wire insertion hole is communicatively connected to the accommodation groove, and the length and the width are both greater than the neutral wire insertion hole.

In an embodiment, a corresponding first inclined block respectively extends from the inclination mechanism in the accommodation groove near the farthest edge at the bottom of the long sidewall plane in the neutral wire insertion hole, and a corresponding second inclined block extends from the long sidewall plane on the other side remote from the neutral wire insertion hole, in which the height of the first inclined block is greater than the height of the second inclined block such that the positioning plate can be slantingly accommodated within the accommodation groove.

In an embodiment, the stopper is located between the two first inclined blocks.

In an embodiment, a positioning space for abutting and accommodating an end of the second elastic body is configured in the accommodation space, and is located between the live wire insertion hole and the earth wire insertion hole.

In an embodiment, the positioning plate is made from a metallic material.

In an embodiment, a positioning space is configured at the bottom of the supporting column for abutting an end of the first elastic body.

In an embodiment, the first elastic body is a spring or an elastic plate.

In an embodiment, the second elastic body is a spring or an elastic plate.

DETAILED DESCRIPTION OF THE PREFERRED EMBODIMENTS

Other technical contents, aspects and effects in relation to the present invention can be clearly appreciated through the detailed descriptions concerning the preferred embodiments of the present invention in conjunction with the appended drawings.

Figure 1:
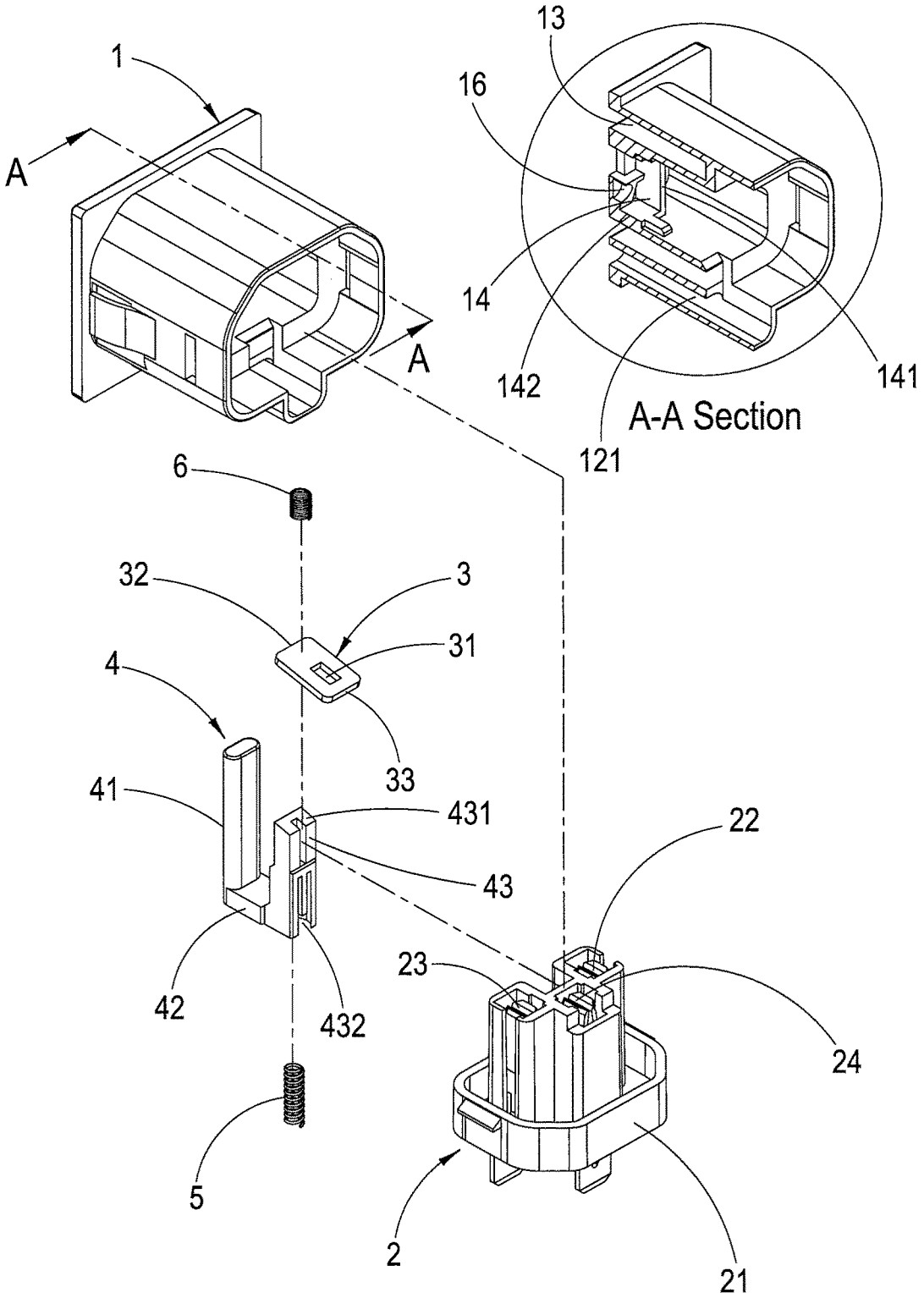
FIG. 1 shows a stereo disassembly view of the socket structure according to the present invention.
Figure 2:
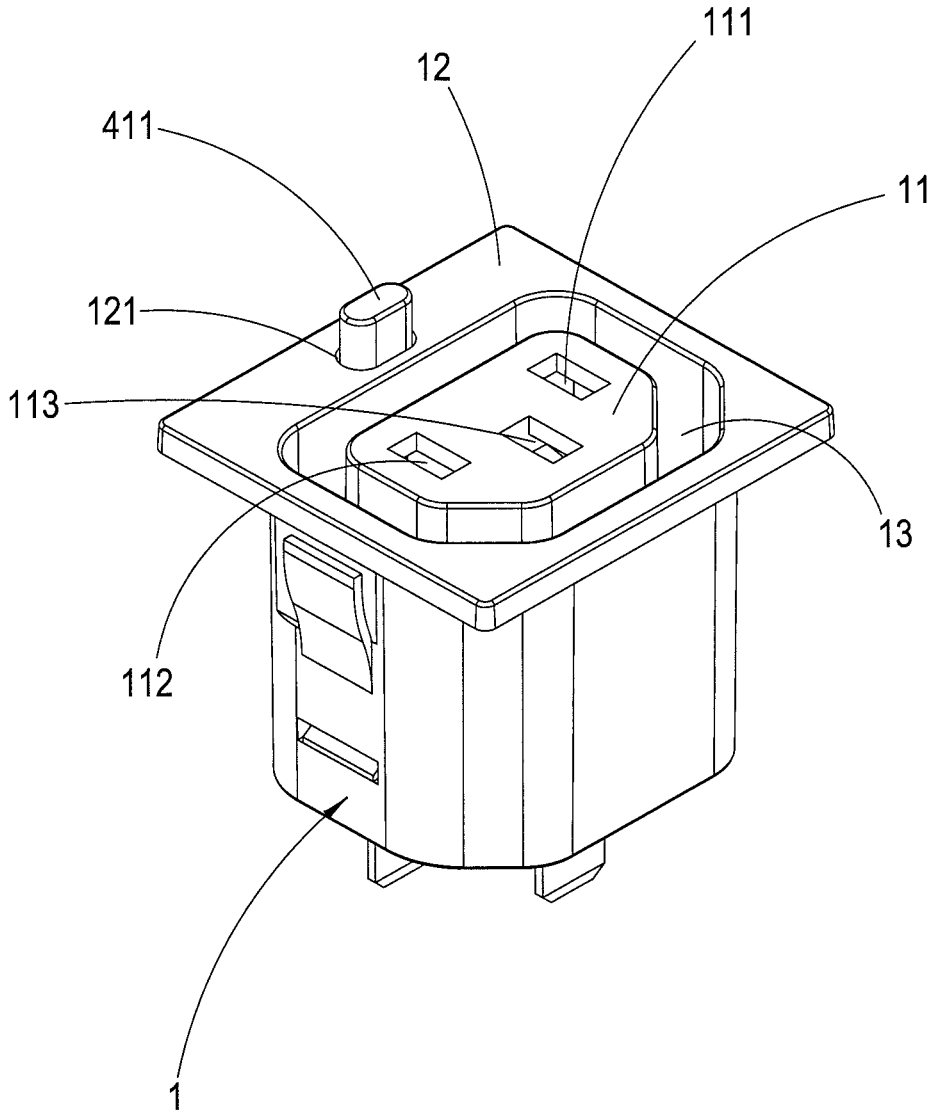
FIG. 2 shows a stereo assembly view of the socket structure according to the present invention.
Figure 3:
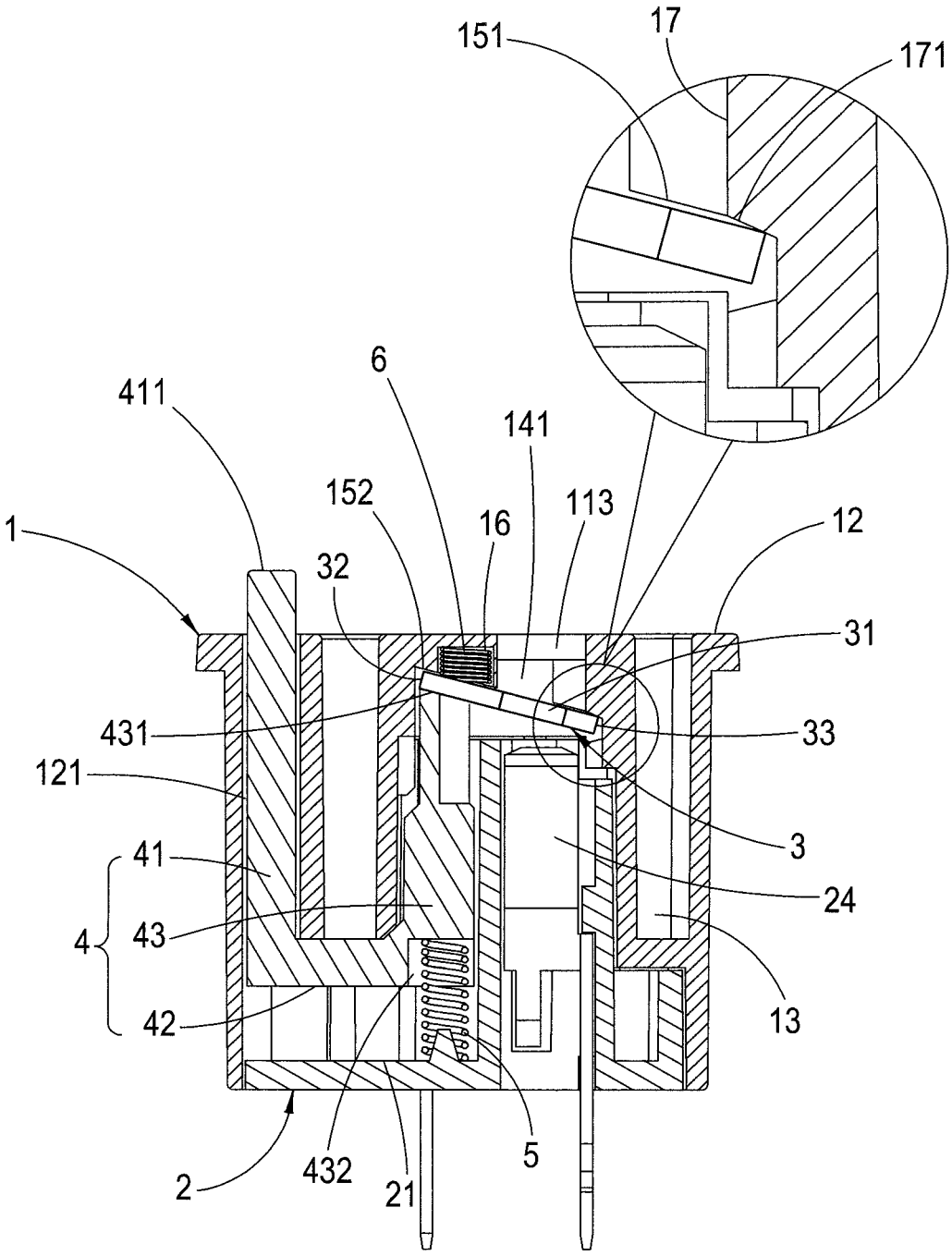
FIG. 3 shows a cross-section view of the socket structure according to the present invention.

Refer initially to FIGS. 1, 2 and 3.It can be appreciated that the present invention essentially comprises an external cover 1, a socket body 2, a positioning plate 3, a release piece 4, a first elastic body 5 and a second elastic body 6, wherein the external cover 1 includes a socket panel 11 and a housing of an outer frame plane 12, while a ring-shaped groove 13 is configured between the socket panel 11 and the outer frame plane 12, the socket panel 11 has a live wire insertion hole 111, an earth wire insertion hole 112 and a neutral wire insertion hole 113, and the outer frame plane 12 includes a channel 121 which leads to the outside of the outer frame plane 12.

Moreover, an accommodation groove 14 extends on the inner wall plane of the socket panel 11 in the external cover 1, the accommodation groove 14 has two corresponding long sidewall planes 141 and short sidewall planes 142, the short sidewall planes 142 are the two corresponding sidewalls of the external cover 1 while the long sidewall planes 141 are formed by respective downward extensions individually from the lateral edge of the live wire insertion hole 111 and the earth wire insertion hole 112 such that the accommodation groove 14 is located between the live wire insertion hole 111 and the earth wire insertion hole 112, while the neutral wire insertion hole 113 is communicatively connected to the accommodation groove 14, and the length and the width are both greater than the neutral wire insertion hole; also, a corresponding first inclined block 151 respectively extends near the farthest edge at the bottom of the long sidewall plane 141 in the neutral wire insertion hole 113, and a corresponding second inclined block 152 extends from the long sidewall plane 141 on the other side remote from the neutral wire insertion hole 113, in which the height of the first inclined block 151 is greater than the height of the second inclined block 152; in addition, a stopper 17 is installed on the short sidewall plane 142 close to the neutral wire insertion hole 113 while the plane at one end of the stopper 17 remote to the socket panel 11 is an inclined plane 171, and the stopper 17 is positioned between the two first inclined blocks 151; further, a positioning space 16 for abutting and accommodating an end of the second elastic body 6 is configured in the accommodation space 14, and is located between the live wire insertion hole 111 and the earth wire insertion hole 112.

Furthermore, the positioning plate 3 is made from a metallic material, an opening 31 is set up thereon and eccentrically configured; in this way, the positioning plate 3 can be accommodated into the accommodation groove 14 of the external cover 1 so that the two end edges of the positioning plate 3 can respectively abut the surfaces of the first inclined block 151 and the second inclined block 152; since the height of the first inclined block 151 is greater than the height of the second inclined block 152, the positioning plate is thus slantingly installed thereby foaming a high edge 32 and a low edge 33 and the opening 31 is close to the low edge 33; besides, the high edge 32 is remote from the neutral wire insertion hole 113, the low edge 33 is near the neutral wire insertion hole 113, and the edge of the low edge 33 contacts the inclined plane 171 of the stopper 17; also, the opening 31 in the positioning plate 3 corresponds to the neutral wire insertion hole 113, and the positioning plate 3 is placed within the accommodation groove 14 such that the positioning plate 3 can be separated from the live wire insertion hole 111 and the earth wire insertion hole 112 by means of the two long sidewall planes 141 in the accommodation groove 14.

Meanwhile, the other end of the second elastic body 6 abuts the surface of the positioning plate 3 close to the high edge 32 so that the second elastic body 6 can be maintained in a compression state (i.e., an elasticity storage state) under normal condition (i.e., the positioning plate 3 is inclined.)

In addition, the release piece 4 includes a press rod 41, a linkage bar 42 and a supporting column 43, wherein an end of the linkage bar 42 is fixedly connected to the bottom of the press rod 41 and the other end fixedly connected to the bottom of the supporting column 43 such that the press rod 41 and supporting column 43 can move conjunctively; also, the top plane of the supporting column 43 is an inclined plane 431, and the bottom is configured with positioning space 432 which is for being abutted by one end of the first elastic body 5; further, the release piece 4 can be combined into the external cover 1 such that the press rod 41 can be jointed with the channel 121 of the outer frame plane 12 and penetrate out of the channel 121; a press head 411 is formed outside of the outer frame plane 12, and the inclined plane 431 at the top of the supporting column 43 may abut the high edge 32 in the positioning plate 3 thereby allowing the positioning plate 3 to be placed inside the accommodation groove 14 and stably maintained in an inclined state.

Besides, the socket body 2 can be combined with the external cover 1 and includes a base stage 21, a live wire power jack 22, an earth wire power jack 23 and a neutral wire power jack 24, in which the live wire power jack 22, the earth wire power jack 23 and the neutral wire power jack 24 respectively correspond to the live wire insertion hole 111, the earth wire insertion hole 112 and the neutral wire insertion hole 113 on the socket panel 11, such that the other end of the first elastic body 5 abuts the base stage 21 of the socket body 2 and the elasticity of the first elastic body 5 is greater than the elasticity of the second elastic body 6.Under normal condition (i.e., the positioning plate 3 is slantingly placed), the first elastic body 5 is in a non-compressed state (i.e., elasticity release state), and since the elasticity of the second elastic body 6 is smaller than the one of the first elastic body 5, the second elastic body 6 remains under compressed condition.

Additionally, the above-said first elastic body 5 and second elastic body 6 may be a spring or elastic plate or any other elastic component.

Figure 4A:
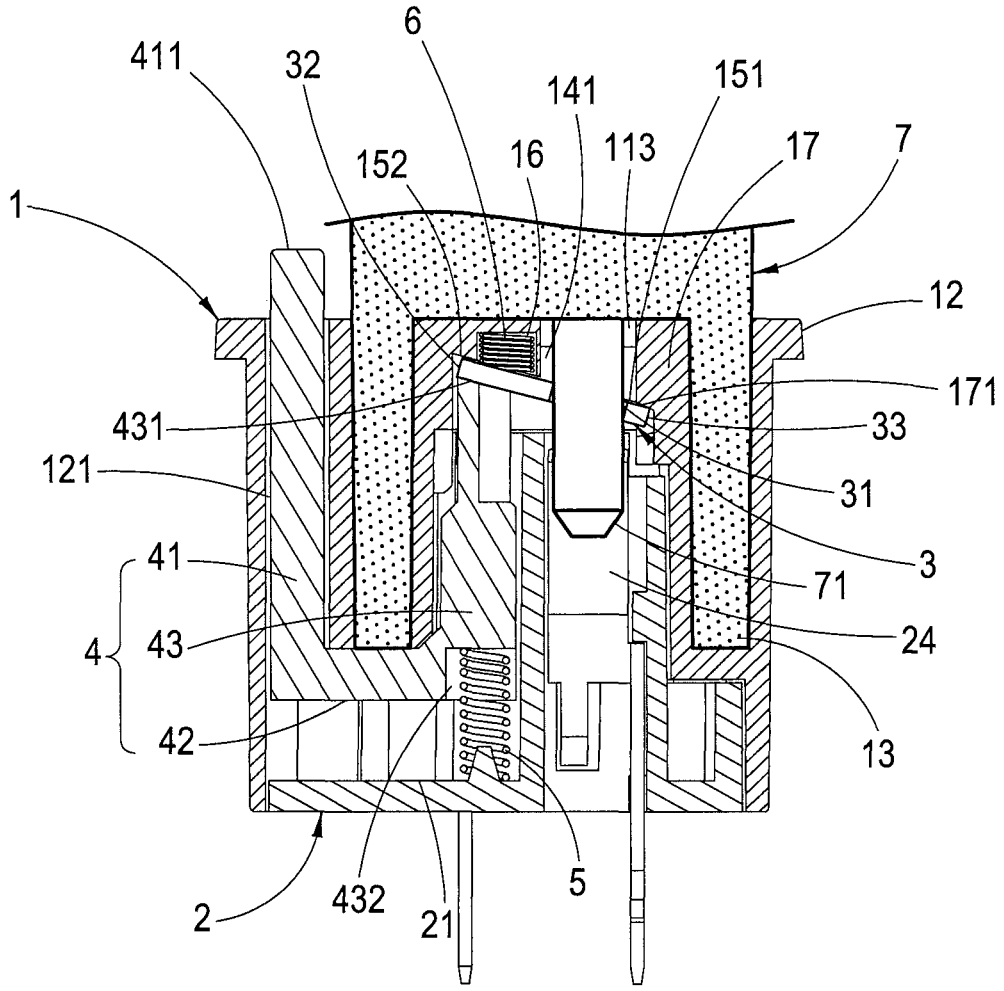
FIG. 4A shows an operative implementation view of the socket structure according to the present invention.
Figure 4B:
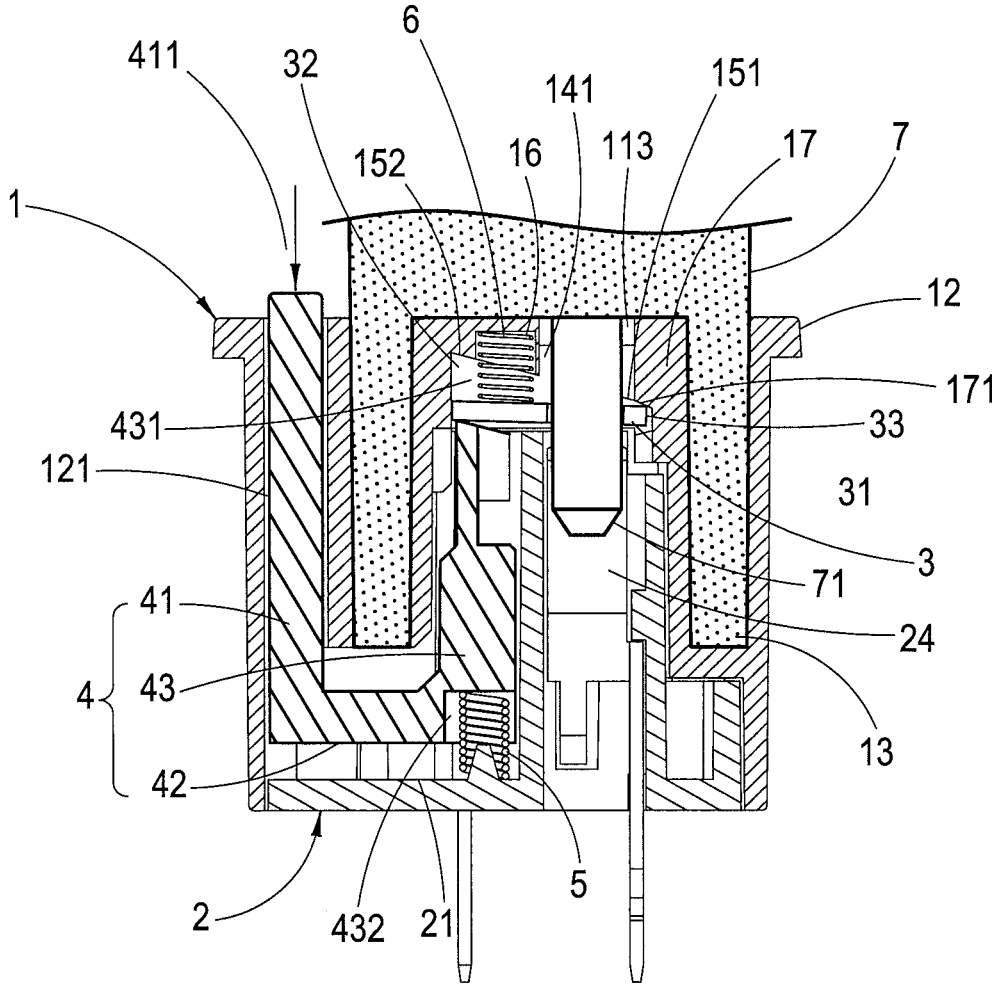
FIG. 4B shows an operative implementation view of the socket structure according to the present invention.
Figure 4C:
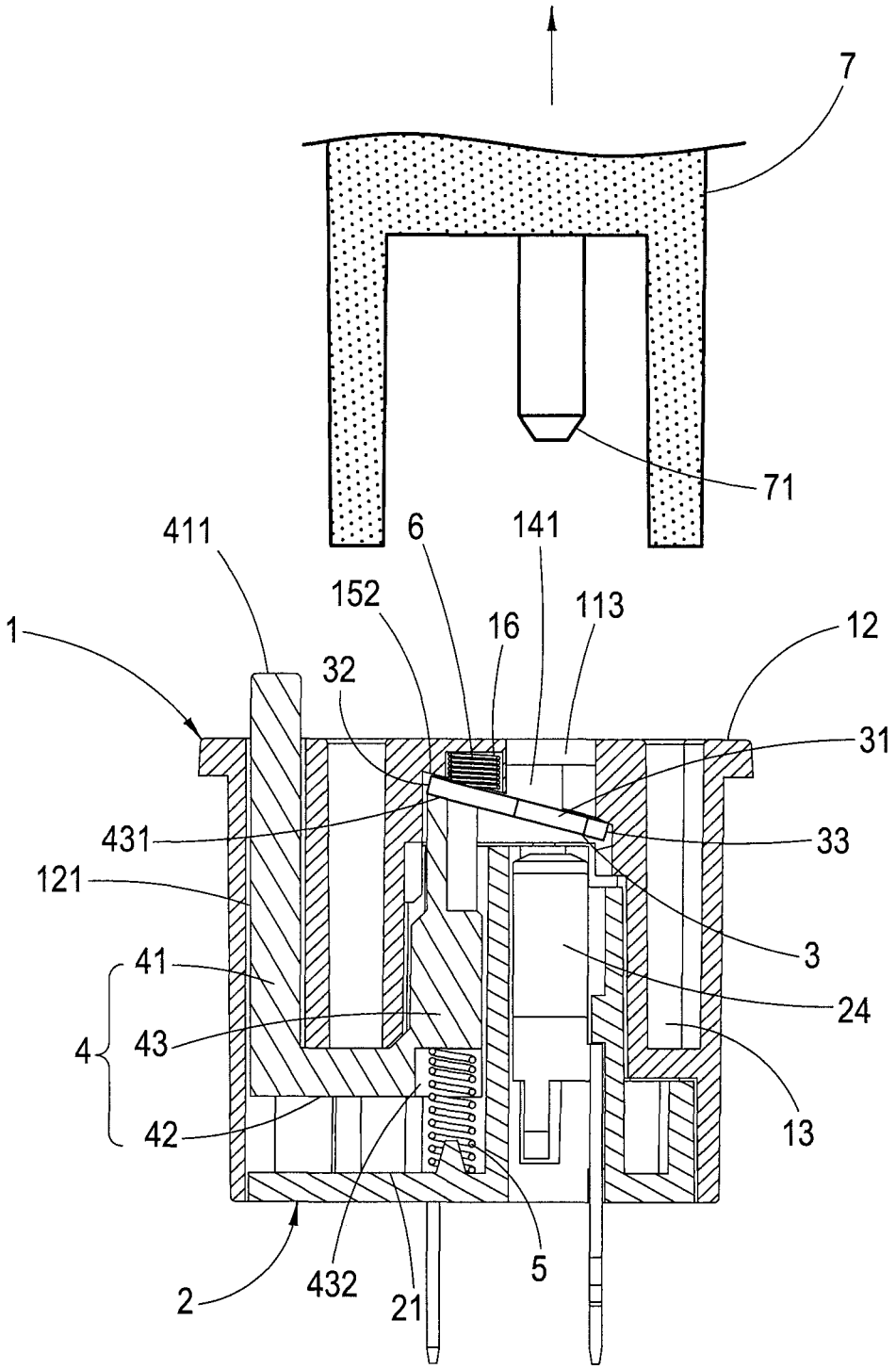
FIG. 4C shows an operative implementation view of the socket structure according to the present invention.

As shown in FIG. 4A, after inserting an electric power plug 7 into the live wire insertion hole 111, earth wire insertion hole 112 and neutral wire insertion hole 113 on the socket panel 11 of the external cover 1 (it should be noticed that the cross section of the electric power plug 7 exhibits a "∩" profile, so the external sides of the electric power plug 7 will be inserted into the ring-shaped groove 13), the live wire insertion plate (not shown), earth wire insertion plate (not shown) and neutral wire insertion plate 71 on the electric power plug 7 can be respectively inserted into the live wire power jack 22, earth wire power jack 23 and neutral wire power jack 24 thereby conducting electric power. Seeing that the positioning plate 3 is separated by the long sidewall planes 141 of the accommodation groove 14, the live wire insertion plate and earth wire insertion plate of the electric power plug 7 will not contact the positioning plate 3 in order to prevent dangerous accidents such as short circuit problems. At this moment, because the size of the neutral wire insertion plate 71 on the electric power plug 7 is smaller than the opening 31 in the positioning plate 3, it will be simultaneously inserted into the opening 31 in the positioning plate 3; moreover, since the opening 31 is bigger than the neutral wire insertion plate 71 and the positioning plate 3 is slantingly installed, the two ends of the opening 31 can respectively clamp on the two ends of the neutral wire insertion plate 71.Moreover, the low edge 33 of the positioning plate 3 is in contact with the inclined plane 171 of the stopper, so, upon pulling the electric power plug 7 out of the socket panel 11, because the edge of the low edge 33 in the positioning plate 3 is blocked by the inclined plane 171 of the stopper to stably keep in the inclined state, thus further stably clamping the neutral wire insertion plate 71, so the electric power plug 7 may not be pulled off from the socket panel 11. On the other hand, upon releasing the electric power plug 7, as shown in FIG. 4B, it is possible to press down the press head 411 of the release piece 4 to make the press rod 41 move downwards, thus driving the supporting column 43 to descend by means of the linkage bar 42 at the same time in order to let the first elastic body 5 be compressed and thus generate elasticity; at this moment, the second elastic body 6 switches from the compression condition to the release condition so as to push the high edge 32 of the positioning plate. Then, because the low edge 33 of the positioning plate 3 contacts the inclined plane 171 of the stopper 17 and the high edge 32 and low edge 33 of the positioning plate 3 are not fixed, when the high edge 32 moves down, the edge of the low edge 33 will be guided by the inclined plane 171 of the stopper 17 to become slightly deviated such that the positioning plate 3 can be driven into a horizontal state thereby allowing to successfully removing the electric power plug 7 (as shown in FIG. 4C.)

In comparison with other conventional technologies, the socket structure according to the present invention provides the following advantages:

1. the present invention allows to abut and hold an electric power plug, once inserted, thereby preventing it from being pulled out and falling off, so it is possible to overcome dangerous situations like power break and accidental electric shock issues caused by plug falloff.

2. the present invention facilitates significant convenience and efficiency with respect to assemblage, which requires only to sequentially combine the second elastic body, positioning plate, release piece, first elastic body and socket body with the external cover without any screw lock-up or mutual snap-in operations among various parts thereby enabling simple assembly and disassembly processes.

It should be noticed that, although the present invention has been disclosed through the detailed descriptions of the above-said embodiments, such illustrations are by no means used to restrict the scope of the present invention; that is, skilled ones in relevant fields of the present invention can certainly devise any applicable alternations and modifications after having comprehended the aforementioned technical characteristics and embodiments of the present invention without departing from the spirit and scope thereof. Hence, the scope of the present invention to be protected under patent laws should be delineated in accordance with the claims set forth hereunder in the present specification.

What is claimed is:

1. A socket structure, comprising:

an external cover, including a socket panel and a housing of an outer frame plane, wherein a ring-shaped groove is configured between the socket panel and the outer frame plane, the socket panel has a live wire insertion hole, an earth wire insertion hole and a neutral wire insertion hole, the outer frame plane has a through channel, an accommodation groove extends on an inner wall plane of the socket panel, an inclination mechanism is set up within the accommodation groove, and a stopper is installed on a short sidewall plane of the accommodation groove close to the neutral wire insertion hole while a plane at one end of the stopper remote to the neutral wire insertion hole is an inclined plane;

a positioning plate, having an eccentrically installed opening, in which the positioning plate is contained within the accommodation groove of the external cover, the inclination mechanism inside the accommodation groove allows the positioning plate to be slantingly installed so that the two ends thereof respectively form a high edge and a low edge, the eccentrically installed opening is close to the low edge near the neutral wire insertion hole and its edge contacts the inclined plane of the stopper, the high edge and the low edge are not fixedly placed within the accommodation groove, and the eccentrically installed opening corresponds to the neutral wire insertion hole;

a second elastic body, in which one end abuts a wall plane of the accommodation groove while the other one end abuts a surface of the positioning plate close to the high edge so as to exhibit an elasticity storage state;

a release piece, which has a press rod, a linkage bar and a supporting column, wherein the two ends of the linkage bar are respectively connected to the press rod and a bottom of the supporting column such that the press rod and supporting column can move conjunctively, and a top of the press rod has a press head, a top plane of the supporting column is an inclined plane; thus, the release piece can be combined into the external cover so that the press rod penetrates through the through channel in the outer frame plane thereby allowing the press head to be exposed to the outside of the through channel, while the inclined plane on a top end of the supporting column abuts the other surface of the high edge in the positioning plate such that the positioning plate can be stably and slantingly accommodated within the accommodation groove;

a socket body, including a base stage, a live wire power jack, an earth wire power jack and a neutral wire power jack, in which the socket body can be combined with the external cover such that the live wire power jack, the earth wire power jack and the neutral wire power jack respectively correspond to the live wire insertion hole, the earth wire insertion hole and the neutral wire insertion hole on the socket panel; and a first elastic body, in which one end abuts a bottom of the release piece while the other end abuts the base stage of the socket body in order to maintain in an elasticity release state, and the elasticity in the first elastic body is greater than the elasticity in the second elastic body.

2. The socket structure according to claim 1, wherein the accommodation groove of the external cover includes two corresponding long sidewall planes and short sidewall planes, and the short sidewall planes are the sidewalls of the external cover while the long sidewall planes are formed by respective downward extensions individually from a lateral edge of the live wire insertion hole and the earth wire insertion hole, such that the accommodation groove is located between the live wire insertion hole and the earth wire insertion hole, while the neutral wire insertion hole is communicatively connected to the accommodation groove, and the length and the width of the accommodation groove are both greater than the neutral wire insertion hole.

3. The socket structure according to claim 2, wherein a corresponding first inclined block respectively extends from the inclination mechanism in the accommodation groove near a farthest edge at a bottom of the long sidewall plane in the neutral wire insertion hole, and a corresponding second inclined block extends from the long sidewall plane on the other side remote from the neutral wire insertion hole, in which the height of the first inclined block is greater than the height of the second inclined block such that the positioning plate can be slantingly accommodated within the accommodation groove.

4. The socket structure according to claim 2, wherein the stopper is located between the two first inclined blocks.

5. The socket structure according to claim 1, wherein a positioning space for abutting and accommodating an end of the second elastic body is configured in the accommodation groove, and is located between the live wire insertion hole and the earth wire insertion hole.

6. The socket structure according to claim 1, wherein the positioning plate is made from a metallic material.

7. The socket structure according to claim 1, wherein a positioning space is configured at the bottom of the supporting column for abutting the other end of the first elastic body.

8. The socket structure according to claim 1, wherein the first elastic body is a spring or an elastic plate.

9. The socket structure according to claim 1, wherein the second elastic body is a spring or an elastic plate.

* * * * *